US005511279A

United States Patent [19]

Ippolito

[11] Patent Number: 5,511,279

[45] Date of Patent: Apr. 30, 1996

[54] STACKABLE PAINT ROLLER PAN HAVING AN INTEGRAL PAINT RESERVOIR, A PAINT ROLLER PARKING DEVICE FOR A ROLLER WITH EXTENDED HANDLE, AND AN ADJUSTABLE ONE-HAND CARRYING HANDLE

[76] Inventor: Nicholas W. Ippolito, 36 Gehrig St., Commack, N.Y. 11725

[21] Appl. No.: 297,572

[22] Filed: Aug. 29, 1994

[51] Int. Cl.[6] ..... B65D 21/032; B44D 3/12

[52] U.S. Cl. ..... 15/257.06; 206/506; 206/519; 220/570; 220/696; 220/697; 220/735; 220/757

[58] Field of Search ..... 15/257.06; 206/506, 206/518, 519; 220/570, 696, 697, 735, 736, 757, 764

[56] References Cited

U.S. PATENT DOCUMENTS

| | | | |
|---|---|---|---|
| 930,445 | 8/1909 | Weaver | 220/764 |
| 1,199,680 | 9/1916 | Fabian | 220/764 |
| 2,204,190 | 6/1940 | Siegel | 15/257.06 |
| 2,909,797 | 10/1959 | White | 15/257.06 |
| 3,641,616 | 2/1972 | Bonci | 15/257.06 |
| 3,756,451 | 9/1973 | Popeil | 220/736 |
| 3,829,926 | 8/1974 | Salladay | 15/257.06 |
| 3,837,034 | 9/1974 | Leffert | 220/570 |
| 4,023,702 | 5/1977 | McKnight | 15/257.06 |
| 4,164,803 | 8/1979 | Zurawin | 15/257.06 |
| 4,205,411 | 6/1980 | Cupp | 15/257.06 |
| 4,509,226 | 4/1985 | Allison | 15/257.06 |
| 4,651,379 | 3/1987 | Kern | 15/257.06 |
| 4,815,604 | 3/1989 | O'Neil | 15/257.06 |
| 5,052,581 | 10/1991 | Christ | 15/257.06 |
| 5,156,411 | 10/1992 | Owens | 15/257.06 |
| 5,178,274 | 1/1993 | Long | 220/697 |
| 5,400,916 | 3/1995 | Weber | 15/257.06 |

FOREIGN PATENT DOCUMENTS

| | | | |
|---|---|---|---|
| 2455015 | 5/1976 | Germany | 15/257.06 |
| 4124716 | 1/1993 | Germany | 220/697 |
| 1547231 | 6/1979 | United Kingdom | 220/570 |

*Primary Examiner*—David Scherbel
*Assistant Examiner*—Randall E. Chin
*Attorney, Agent, or Firm*—Galgano & Burke

[57] ABSTRACT

A paint roller pan includes a relatively deep distal paint reservoir and a relatively shallow inclined roller ramp. The proximal end of the roller ramp is provided with a downward extending flared support with distally extending feet for engaging a step ladder. The reservoir and the ramp are separated by a dam having a central notch through which paint drains from the ramp into the reservoir. An inner side wall of the pan is provided with a vertical V-shaped notch on the proximal side of the dam for engaging the arm of a paint roller with an extended handle and holding it in a vertically fixed position. Two outer side walls of the pan have notched handle receiving slots. A handle with hooked ends engages the notched slots and is movable to engage appropriate notches so that the pan is balanced when lifted with one hand regardless of how much paint it is holding. Preferred aspects of the paint roller pan include: tapering the side walls of the reservoir and the ramp so that the pan is stackable, providing an upper edge lip with gussets to facilitate stacking, forming the handle as a single resilient molded member with a ribbed gripping surface, providing ribs on the floor of the ramp and paint draining channels on the left and right sides of the ramp ribs. The presently preferred embodiment of the paint roller pan is dimensioned to hold a full quart of paint.

11 Claims, 4 Drawing Sheets

Fig. 4
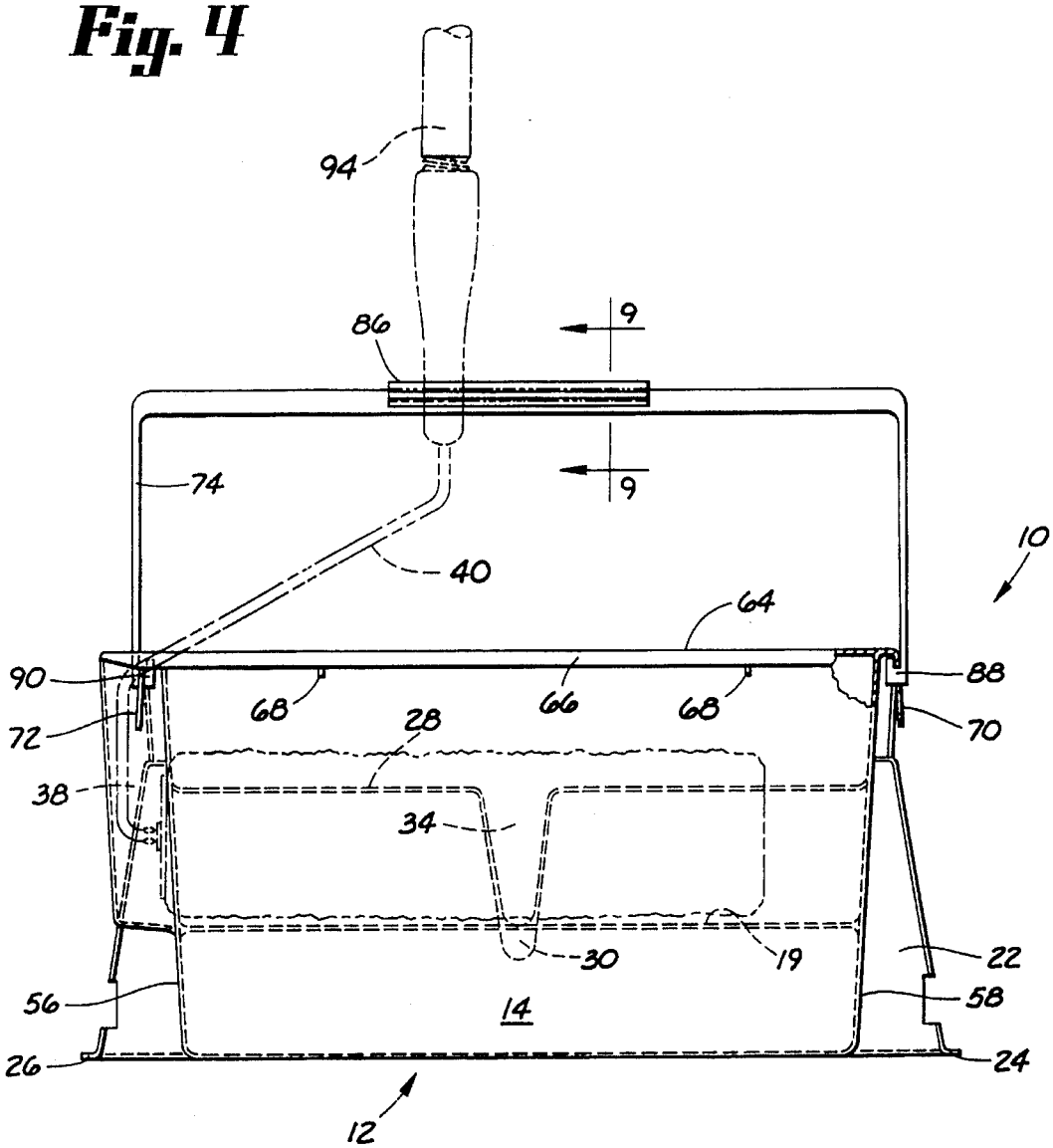
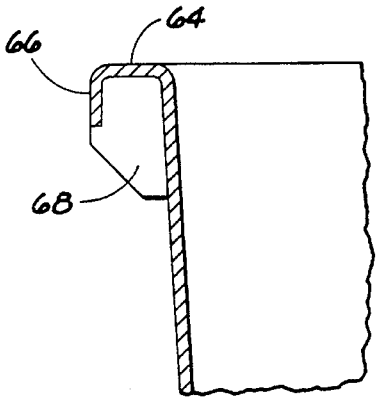
Fig. 6
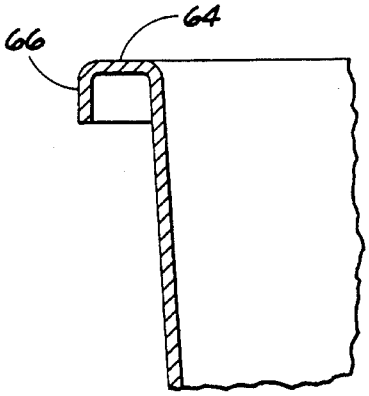
Fig. 7

Fig. 5
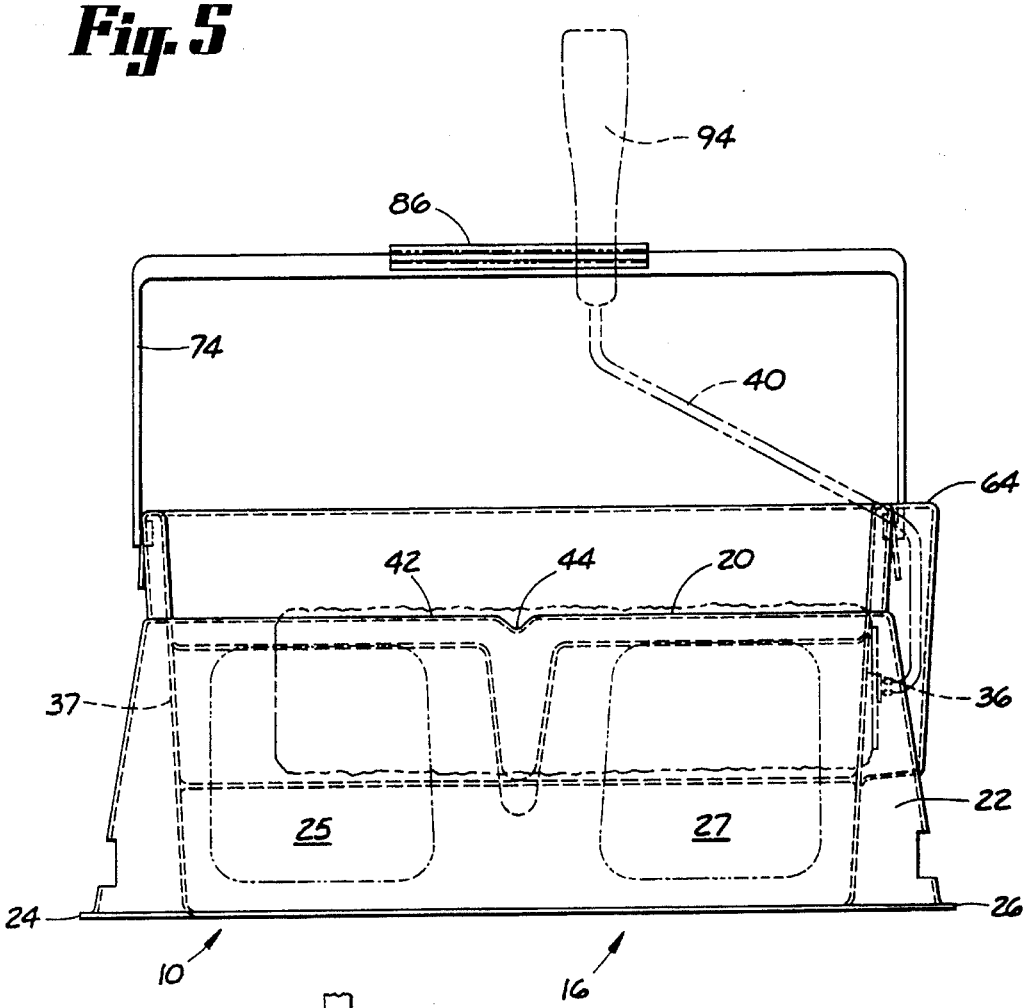
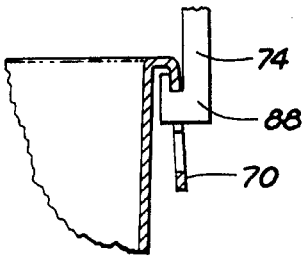
Fig. 8
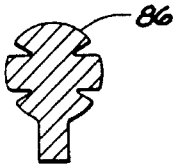
Fig. 9
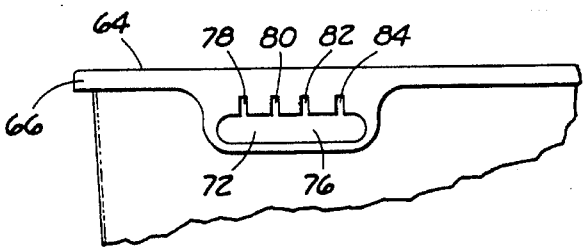
Fig. 10

STACKABLE PAINT ROLLER PAN HAVING AN INTEGRAL PAINT RESERVOIR, A PAINT ROLLER PARKING DEVICE FOR A ROLLER WITH EXTENDED HANDLE, AND AN ADJUSTABLE ONE-HAND CARRYING HANDLE

BACKGROUND OF THE INVENTION

1. Field of the Invention

The invention relates to a roller pan for use with a paint roller. More particularly, the invention relates to a stackable paint roller pan having an integral paint reservoir, a paint roller parking device, and an adjustable one-hand carrying handle. It also is equipped with a side wall slot to hold a roller with an extended handle in a vertical rest position.

All these advantages are accomplished with the most important consideration being to make the product available to the customer at a practical, minimum cost.

2. State of the Art

The ubiquitous paint roller tray in use today is a simple aluminum pan which measures approximately ten inches wide and approximately twelve to fourteen inches long. The bottom of the tray is inclined to define a distal paint containing well and a proximal ribbed "rollout" surface. The proximal end of the tray is usually provided with a pair of C-shaped legs which balance the tray when it is placed on a level surface and which allow the tray to be attached to a step ladder. This type of tray is simple and inexpensive, but has several well known disadvantages. The tray does not hold much paint and needs to be refilled frequently. If the tray is over-filled, the paint will cover the "rollout" area rendering it useless and resulting in excessive paint being applied to the roller. When filled with paint, the tray is unbalanced and must be carefully carried, usually with two hands, to avoid spilling. In order to hold sufficient paint, these trays are often longer than the overall length of a paint roller handle. Thus, if the paint roller is not carefully positioned in the tray, it will likely roll down the rollout area allowing the handle to dip into paint.

Some attempts have been made to overcome these several disadvantages of the simple paint roller tray. Exemplary of these improvements, is the "painter's caddy" described in U.S. Pat. No. 3,837,034 to Leffert et al. Leffert et al. describes a deep rectangular paint pail having a steep roller ramp and a pair of folding carrying handles. The upper edge of the roller ramp is provided with a notch for receiving the handle of a paint roller. The paint pail is also provided with a clip for holding brushes and a storage compartment for holding other supplies. While the painter's caddy demonstrates some interesting concepts, it does not overcome all of the disadvantages of the simple roller tray and has some new disadvantages of its own. The simple notch in the upper edge of the roller ramp is insufficient to prevent the roller from rolling down into the paint well when the handle is disturbed. The steep angle of the roller ramp increases the overall dimensions of the caddy without increasing paint capacity. Also, the steep angle of the roller ramp creates a difficult angle of attack when pressing against it to remove paint from the roller. The tendency is for the paint pail to move backward. The design proposed forecloses the possibility of stacking the paint caddies. The use of two carrying handles makes it more difficult to lift and lifting one of the handles will likely disturb the paint roller and cause it to roll down the ramp into the paint well. Furthermore, the pail lacks stackability.

SUMMARY OF THE INVENTION

It is therefore an object of the invention to provide a paint roller pan which has a relatively large paint capacity.

It is also an object of the invention to provide a paint roller pan which has a positive roller parking device so that it is virtually impossible for the paint roller handle to fall into the paint or for the paint roller to fall out of the pan.

It is another object of the invention to provide a paint roller pan which can be manufactured with a plastic molding process.

It is still another object of the invention to provide a paint roller pan which is stackable to make efficient use of shelf space.

It is also an object of the invention to provide a paint roller pan with an adjustable carrying handle so that the pan can be quickly and easily lifted with one hand.

It is also an object of the invention to safely park in the rest area a roller with an extended handle in a vertical position utilizing a side wall slot specifically designed for this purpose.

In accord with these objects which will be discussed in detail below, the paint roller pan of the present invention includes a molded plastic pan having a relatively deep distal paint reservoir and a relatively shallow inclined roller ramp. The proximal end of the roller ramp is provided with a downward extending flared support with distally extending feet for engaging a step ladder. The reservoir and the ramp are separated by a dam having a central notch through which paint drains from the ramp into the reservoir. An inner side wall of the pan is provided with a vertical V-shaped notch on the proximal side of the dam for engaging the arm of a paint roller and holding it in a vertically fixed position when used with a roller extended handle. Two outer side walls of the pan have notched handle receiving slots. A handle with hooked ends engages the notched slots and is movable to engage appropriate notches so that the pan is balanced when lifted with one hand regardless of how much paint it is holding.

Preferred aspects of the paint roller pan include: tapering the side walls of the reservoir and the ramp so that the pan is stackable, providing an upper edge lip with gussets to facilitate stacking, forming the handle as a single resilient molded member with a ribbed gripping surface, providing ribs on the floor of the ramp and paint draining channels on the left and right sides of the ramp ribs. The presently preferred embodiment of the paint roller pan is dimensioned to hold a full quart of paint. Additional objects and advantages of the invention will become apparent to those skilled in the art upon reference to the detailed description taken in conjunction with the provided figures.

BRIEF DESCRIPTION OF THE DRAWINGS

FIG. 4 is a distal end view of the paint roller pan; showing, in phantom, the paint roller with its extended handle in vertical position while engaged in the side wall groove.

FIG. 5 is a proximal end view of the paint roller pan;

FIG. 6 is a cross sectional view along line 6—6 in FIG. 2;

FIG. 7 is a cross sectional view along line 7—7 in FIG. 2;

FIG. 8 is an enlarged broken view in partial section showing a hooked end of the handle engaging a notched slot;

FIG. 9 is a cross sectional view along line 9—9 in FIG. 4; and

FIG. 10 is a broken enlarged view of a notched handle receiving slot.

DETAILED DESCRIPTION OF THE PREFERRED EMBODIMENTS

Figure 1:
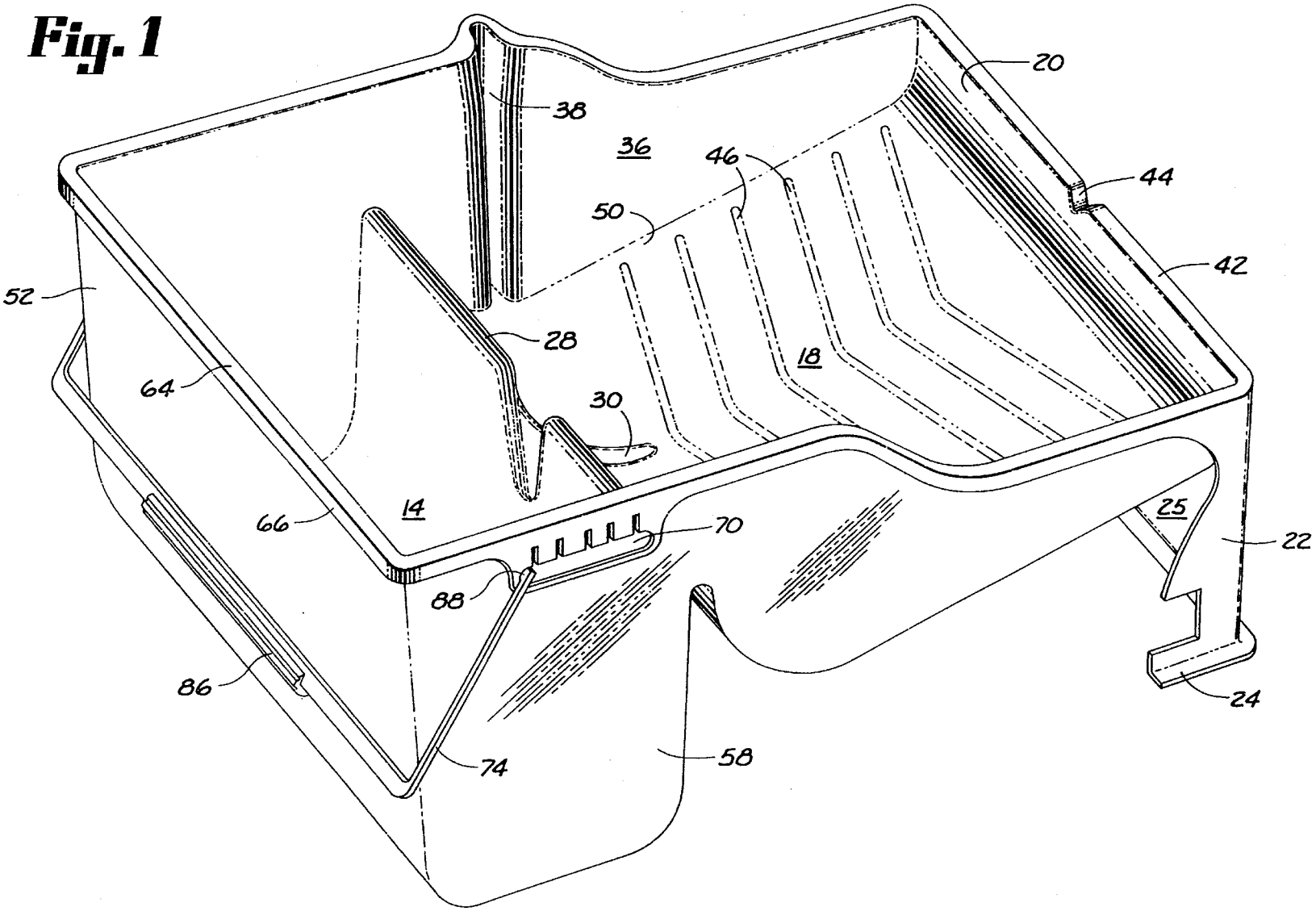
FIG. 1 is a perspective view of the paint roller pan according to the invention.
Figure 2:
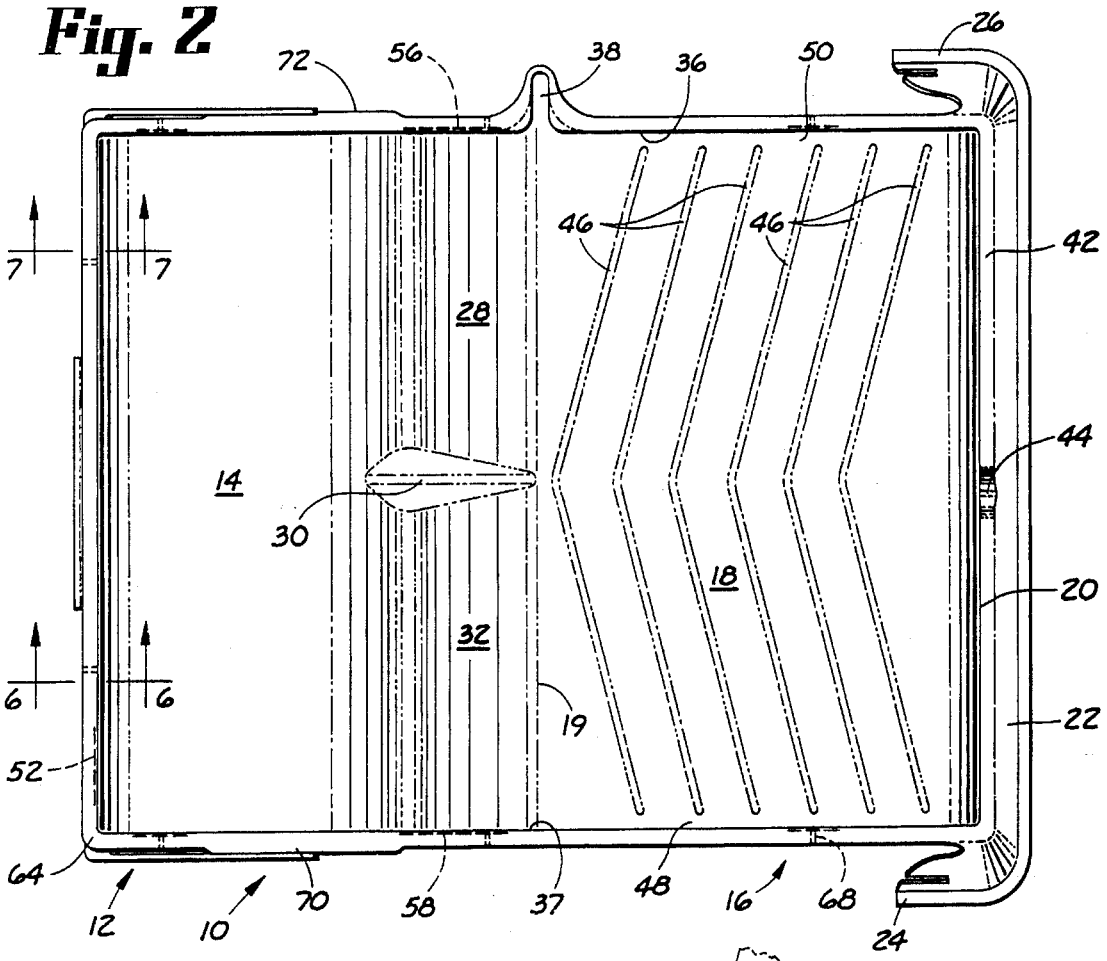
FIG. 2 is a top plan view of the paint roller pan according to the invention.

Referring now to FIGS. 2 through 5, the paint roller pan 10 according to the invention is preferably an integral injection molded plastic container with overall dimensions of approximately fourteen inches wide by sixteen inches long and six inches tall. A distal portion 12 of the pan 10 is formed as a relatively deep paint reservoir 14 and a proximal portion 16 of the pan 10 is formed as a relatively shallow roller ramp 18. According to the presently preferred embodiment, the reservoir 14 is approximately five inches by eleven inches and six inches deep. The ramp 18 is preferably inclined at an angle of approximately ten degrees and its deepest part 19 is approximately two inches above the deepest part of the reservoir 14. The proximal end 20 of the ramp 18 is provided with a flared downward extending support 22 which has a pair of distally extending feet 24, 26. As seen best in FIG. 5, the support 22 may be provided with cut outs 25, 27 for material economy. The paint reservoir 14 and the roller ramp 18 are preferably separated by an upstanding dam 28 having a central paint draining passage 30. The proximal side of the dam 28 is provided with a curved surface 32 to accommodate the curvature of a paint roller 34 as seen best in FIG. 3. According to the presently preferred embodiment, the dam 28 rises approximately two inches up from the deepest part 19 of the ramp 18. At least one side wall 36 is provided with a vertical groove 38 on its inner surface proximal of the dam 28 for receiving the arm 40 of the paint roller 34. As seen best in FIGS. 4 and 5, this groove 38 holds the arm 40 of the paint roller 34 that is attached to an extension handle 94 in a vertical position on the proximal side of the dam 28 and "parks" the paint roller 34 and extended handle 94. The upper edge 42 of the proximal end 20 of the ramp 18 is also provided with a notch 44 for holding the paint roller arm in a conventional manner.

The floor of the ramp 18 is preferably provided with a plurality of ribs 46 and a pair of paint draining channels 48, 50 arranged on either side of the ribs for removing excess paint from the roller in a conventional manner.

Figure 3:
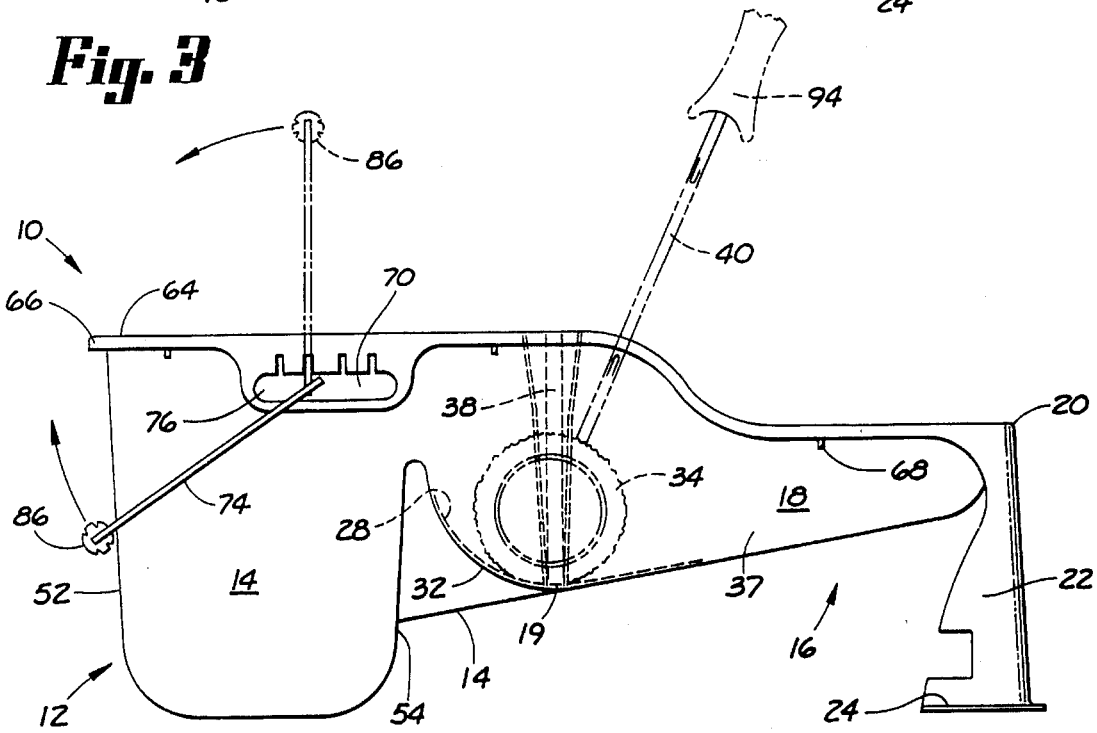
FIG. 3 is a side elevational view of the paint roller pan with a paint roller and an extended handle shown in phantom lines.

As seen best in FIGS. 3, 4, and 5, the side walls 52, 54, 56, and 58 of the reservoir 14 and the side walls 36, 37 of the ramp 18 are tapered to facilitate stacking. Likewise, the dam 28 and the draining passage 30 are shaped to aid in stacking the pans. In addition, the upper edge 64 of the pan 10 is provided with a peripheral lip 66 having a plurality of spaced apart gussets 68 which are seen best in FIGS. 3, 4, and 6. The gussets strengthen the lip and prevent the pan 10 from nesting too deeply when stacking, thus preventing the pan from being "stuck" inside another pan. The peripheral lip 66 also forms a pair of notched handle receiving slots 70, 72 for receiving a movable handle 74.

As seen best in FIGS. 3 and 10, each slot, e.g. slot 72 includes a horizontal portion 76 and a plurality of vertical notches 78, 80, 82, and 84. The slots are dimensioned and located so that the notches substantially align with the center of gravity of the pan 10 which, of course, differs depending on how much paint is contained in the reservoir 14. The handle 74, which is seen best in FIGS. 4, 8, and 9, has a central ribbed gripping surface 86 and a pair of hooked ends 88, 90. The hooked ends 88, 90 are dimensioned to engage the slots 70, 72 and respective notches in the slots as shown for example in FIG. 8. Those skilled in the art will appreciate that the handle 74 is thereby adjustable relative to the pan 10 so that the pan will be balanced when lifted by the handle regardless of how much paint is contained in the reservoir 14. According to the presently preferred embodiment, the handle 74 is formed as a resilient molded plastic member which engages the notched slots 70, 72. The slots 70, 72 and notches 78, 80, 82, 84 are designed so that when the handle 74 is not in use, the hooked ends 88, 90 of the handle 74 drop down to the slot area horizontal portion 76 allowing the handle 74 to swing out of the work area and rest on the side of the pail.

There have been described and illustrated herein a stackable paint roller pan having an integral paint reservoir, a roller parking device and an adjustable handle. While particular embodiments of the invention have been described, it is not intended that the invention be limited thereto, as it is intended that the invention be as broad in scope as the art will allow and that the specification be read likewise. Thus, while particular dimensions have been disclosed, it will be appreciated that other dimensions could be utilized. Also, while flared and tapered walls have been shown to facilitate stacking, it will be recognized that other types of walls could be used without providing for stacking but still obtaining many of the other features of the invention. Moreover, while particular configurations have been disclosed in reference to dam, it will be appreciated that other configurations could be used as well. Furthermore, while the ramp has been disclosed as having a particular angle and certain floor ribs, it will be understood that different configurations of the ramp can achieve the same or similar function as disclosed herein. It will therefore be appreciated by those skilled in the art that yet other modifications could be made to the provided invention without deviating from its spirit and scope as so claimed.

What is claimed is:

1. A paint roller pan comprising:

a) a relatively deep paint reservoir;

b) a relatively shallow, inclined roller ramp;

c) a paint dam separating said reservoir from said ramp;

d) means for engaging the arm of a paint roller to hold the arm of the paint roller in a substantially vertical position and to prevent the arm of said paint roller from moving forward and backward out of said substantially vertical position;

e) a movable handle having a pair of hooked ends; and f) means for engaging said pair of hooked ends of said movable handle comprising a pair of slots formed within said roller pan, each of said slots having a plurality of notches so that said handle may be engaged via its hooked ends to said pan at different longitudinal positions relative to said ramp and said reservoir to permit lifting of said pan via said handle in a balanced manner.

2. A paint roller pan according to claim 1, wherein:

said roller pan has at least one upstanding sidewall; and said means for engaging the arm of said paint roller comprises a substantially vertical groove located in said at least one sidewall of said roller pan.

3. A paint roller pan according to claim 1, further comprising:

g) at least one paint draining passage in said dam for allowing paint to drain from said ramp into said reservoir.

4. A paint roller according to claim 1, further comprising:

g) a proximal portion located at one end of said ramp; and h) a supporting leg extending downward from said proximal portion of said ramp, said supporting leg having at least one distally extending foot for engaging a step ladder.

5. A paint roller pan according to claim 4, wherein:

said supporting leg flares outward and said reservoir and said ramp are tapered inward so that said roller pan is stackable.

6. A paint roller pan according to claim 5, further comprising:

i) a peripheral upper lip surrounding said reservoir and said ramp, said lip having a plurality of gussets.

7. A paint roller pan comprising:

a) a relatively deep paint reservoir;

b) a relatively shallow, inclined roller ramp;

c) a paint dam separating said reservoir from said ramp;

d) a supporting leg extending downward from said ramp, wherein, said reservoir and said ramp have inwardly tapered side walls and said supporting leg flares outward so that said pan is stackable;

e) movable handle having a pair of hooked ends; and f) means for engaging said movable handle with at least two different locations relative to said ramp and said reservoir, said engaging means comprising a pair of slots each having a plurality of notches formed therein.

8. A paint roller pan according to claim 7, further comprising:

g) a paint draining passage in said dam for allowing paint to drain from said ramp into said reservoir.

9. A paint roller pan according to claim 7, further comprising:

g) a peripheral upper lip surrounding said reservoir and said ramp, said lip having a plurality of gussets.

10. A paint roller pan comprising:

a) a relatively deep paint reservoir;

b) a relatively shallow, inclined roller ramp having at least one upstanding sidewall disposed laterally of said ramp; and c) means for engaging the arm of a paint roller to hold the paint roller arm in a substantially vertical position and prevent the paint roller arm from moving forward and backward out of said substantially vertical position, said means for engaging comprising a substantial vertical groove formed in said sidewall of said ramp so that when said arm of said roller is received in said groove, said paint roller will rest on said inclined ramp with said arm in an upstanding position.

11. A one-piece paint roller pan comprising:

a) a relatively deep paint reservoir;

b) a relatively shallow, inclined roller ramp; and c) a paint dam separating said reservoir from said ramp, said paint dam having at least one paint draining passage for allowing paint to drain from said ramp into said reservoir, said dam having a side facing said ramp and having a curved surface to accomodate the curvature of a paint roller.

* * * * *